US009283747B2

(12) United States Patent
Van Brocklin et al.

(10) Patent No.: US 9,283,747 B2
(45) Date of Patent: Mar. 15, 2016

(54) FLUID EJECTION DEVICES AND METHODS THEREOF

(75) Inventors: Andrew L Van Brocklin, Corvallis, OR (US); Adam L Ghozeil, Corvallis, OR (US); Daryl E Anderson, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/125,658

(22) PCT Filed: Oct. 24, 2011

(86) PCT No.: PCT/US2011/057506

§ 371 (c)(1), (2), (4) Date: Dec. 12, 2013

(87) PCT Pub. No.: WO2013/062516

PCT Pub. Date: May 2, 2013

(65) Prior Publication Data

US 2014/0132659 A1 May 15, 2014

(51) Int. Cl.

| | |
|---|---|
| ***B41J 29/393*** | (2006.01) |
| ***B41J 2/045*** | (2006.01) |
| ***B41J 2/175*** | (2006.01) |
| ***B41J 2/14*** | (2006.01) |
| ***B41J 29/377*** | (2006.01) |
| ***B41J 29/38*** | (2006.01) |

(52) U.S. Cl.

CPC ..... *B41J 2/04563* (2013.01); *B41J 2/0454* (2013.01); *B41J 2/04528* (2013.01); *B41J 2/04555* (2013.01); *B41J 2/04586* (2013.01); *B41J 2/14* (2013.01); *B41J 2/175* (2013.01); *B41J 2/17509* (2013.01); *B41J 29/377* (2013.01); *B41J 29/38* (2013.01); *B41J 2202/08* (2013.01)

(58) Field of Classification Search

USPC ..... 347/17, 19, 68, 7, 5

See application file for complete search history.

(56) References Cited

U.S. PATENT DOCUMENTS

| | | | | |
|---|---|---|---|---|
| 6,474,769 | B1 * | 11/2002 | Imanaka et al. | 347/19 |
| 6,685,290 | B1 | 2/2004 | Farr et al. | |
| 7,551,862 | B2 | 6/2009 | Tanaka et al. | |
| 7,918,524 | B2 | 4/2011 | Sheahan et al. | |
| 2004/0223021 | A1 | 11/2004 | Farr et al. | |
| 2005/0001863 | A1 * | 1/2005 | Farr et al. | 347/7 |

(Continued)

FOREIGN PATENT DOCUMENTS

| | | | |
|---|---|---|---|
| CN | 1756663 | A | 4/2006 |
| CN | 101954788 | A | 1/2011 |

(Continued)

OTHER PUBLICATIONS

PCT Search Report/Written Opinion—Application No. PCT/US2011/057506 dated Jun. 12, 2012—9 pages.

*Primary Examiner* — Lam Nguyen

(74) *Attorney, Agent, or Firm* — HP Inc. Patent Department

(57) ABSTRACT

Fluid ejection devices and methods thereof are disclosed in the present disclosure. A method includes establishing fluid communication between an ejection chamber and a fluid supply chamber of the fluid ejection device such that the ejection chamber includes a nozzle and an ejection member to selectively eject fluid through the nozzle. The method also includes detecting at least one impedance in the fluid by a sensor unit having a sensor plate.

10 Claims, 11 Drawing Sheets

(56) References Cited

U.S. PATENT DOCUMENTS

| | | | | |
|---|---|---|---|---|
| 2006/0071983 | A1* | 4/2006 | Stearns et al. | 347/68 |
| 2011/0142466 | A1 | 6/2011 | Willard et al. | |

FOREIGN PATENT DOCUMENTS

| | | | |
|---|---|---|---|
| JP | 03275360 | A | 12/1991 |
| JP | 06218944 | A | 8/1994 |
| JP | H08-001947 | | 1/1996 |
| JP | H09-085964 | | 3/1997 |
| JP | H10-034971 | | 2/1998 |
| JP | H11-070651 | | 3/1999 |
| JP | H11-129496 | | 5/1999 |
| JP | H11-334102 | | 12/1999 |
| JP | 2000-318172 | | 11/2000 |
| JP | 2001-293900 | | 10/2001 |
| JP | 2002-307697 | | 10/2002 |
| JP | 2003-118101 | | 4/2003 |
| JP | 2003316143 | A | 11/2003 |
| JP | 2005-041212 | | 2/2005 |
| JP | 2006-103004 | | 4/2006 |
| JP | 2006184705 | A | 7/2006 |
| JP | 2007-185804 | | 7/2007 |
| JP | 2007237706 | A | 9/2007 |
| JP | 2008-049672 | | 3/2008 |
| JP | 2011-079251 | | 4/2011 |

* cited by examiner

FLUID EJECTION DEVICES AND METHODS THEREOF

CROSS REFERENCE TO RELATED APPLICATIONS

This application is a national stage application under 35 U.S.C. §371 of PCT/US2011/057506, filed Oct. 24, 2011, which is incorporated herein by reference in its entirety.

This application is related to commonly-owned patent application serial nos. PCT/US2011/057488, entitled "FLUID EJECTION SYSTEMS AND METHODS THEREOF" and filed contemporaneously herewith by Adam L, Ghozeil, Daryl E. Anderson, and Andrew L. Van Brocklin; PCT/US2011/057515, entitled "INKJET PRINTHEAD DEVICE, FLUID EJECTION DEVICE, AND METHOD THEREOF" and filed contemporaneously herewith by Andrew L. Van Brocklin, Adam L. Ghozeil, and Daryl E. Anderson; and PCT/US2011/057509, entitled "INKJET PRINTING SYSTEM, FLUID EJECTION SYSTEM, AND METHOD THEREOF" and filed contemporaneously herewith by Andrew L. Van Brocklin, Adam L. Ghozeil, and Daryl E. Anderson; and which related applications are incorporated herein by reference in their entirety.

BACKGROUND

Fluid ejection devices may include a fluid supply chamber to store fluid and a plurality of ejection chambers to selectively eject fluid onto objects. The fluid ejection devices may include inkjet printhead devices to print images in a form of ink onto media.

BRIEF DESCRIPTION OF THE DRAWINGS

Non-limiting examples of the present disclosure are described in the following description, read with reference to the figures attached hereto and do not limit the scope of the claims, in the figures, identical and similar structures, elements or parts thereof that appear in more than one figure are generally labeled with the same or similar references in the figures in which they appear. Dimensions of components and features illustrated in the figures are chosen primarily for convenience and clarity of presentation and are not necessarily to scale. Referring, to the attached figures:

DETAILED DESCRIPTION

In the following detailed description, reference is made to the accompanying drawings which form a part hereof, and in which is depicted by way of illustration specific examples in which the present disclosure may be practiced. It is to be understood that other examples may be utilised and structural or logical changes may be made without departing from the scope of the present disclosure. The following detailed description, therefore, is not to be taken in a limiting sense, and me scope of the present disclosure is defined by the appended claims.

Fluid ejection devices provide fluid onto objects. The fluid ejection devices may include a fluid supply chamber to store fluid. The fluid ejection devices may also include a plurality of ejection chambers including nozzles and corresponding ejection members to selectively eject the fluid through the respective nozzles. The fluid ejection devices may include inkjet printhead devices to print images in a form of ink onto media. Impedance of the fluid in the fluid ejection devices may impact and/or be indicative of the ability of the fluid ejection devices to adequately provide the fluid onto the objects. Fluid ejection devices may include service routines to refresh and/or condition the fluid to reduce it from negatively impacting the ability of the fluid ejection device to adequately provide the fluid onto the object.

Examples of the present disclosure include fluid ejection devices and methods thereof to defect at least one impedance in fluid. In examples, a fluid ejection device may include, amongst other things, a temperature adjustment module to establish at least one temperature of the fluid of the fluid ejection device. The fluid ejection device may also include a sensor unit having a sensor plate to detect at least one impedance in the fluid corresponding to the at least one temperature. For example, the sensor plate may be disposed in one of an ejection chamber and a channel. Thus, the sensor unit may detect the impedance of the fluid, for example, without wasting fluid and decreasing the throughput of the fluid ejection device.

Figure 1:
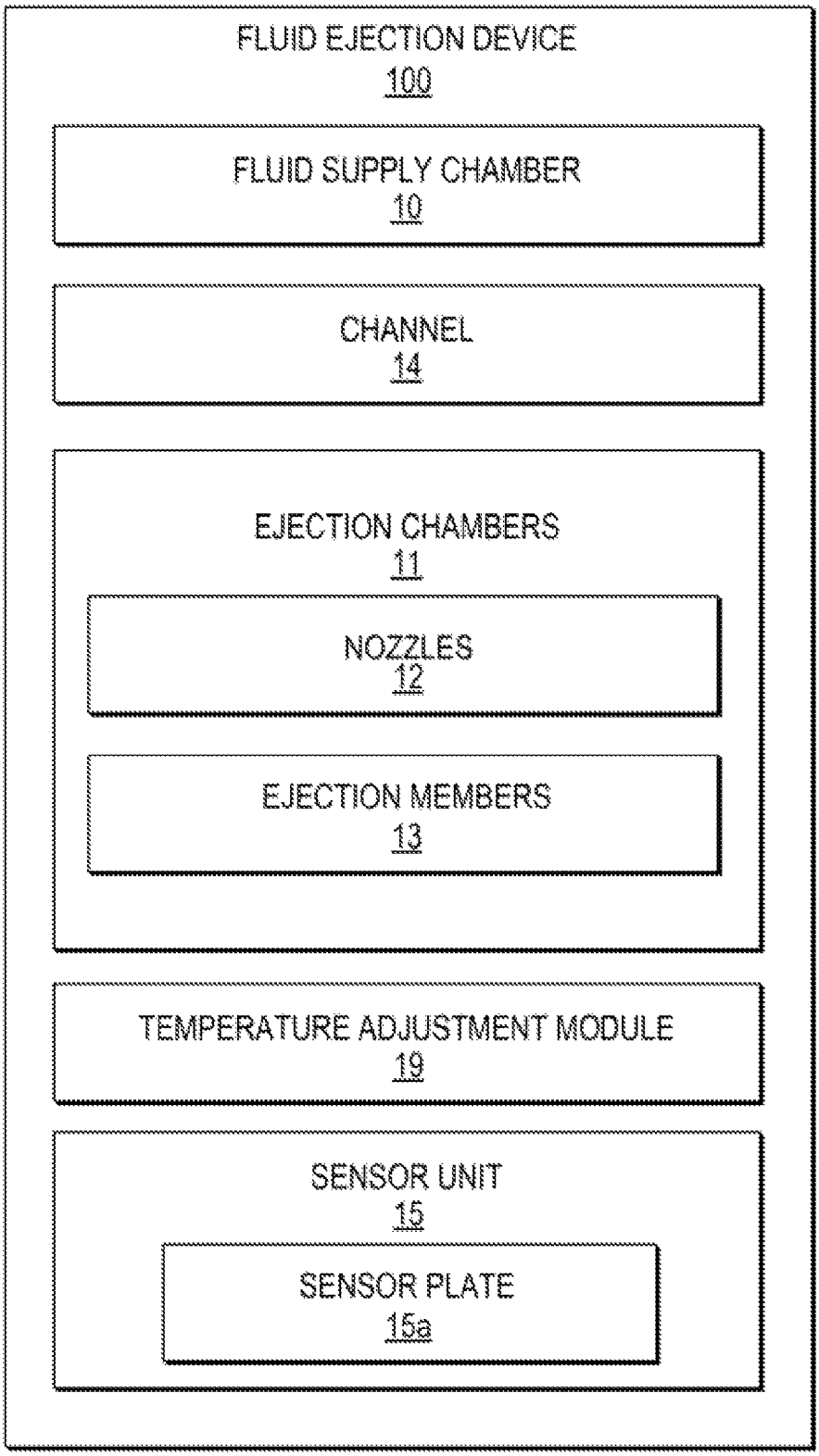
FIG. 1 is a block diagram illustrating a fluid ejection device according to am example.

FIG. 1 is a block diagram illustrating a fluid ejection device according to an example. Referring to FIG. 1, in some examples, a fluid ejection device 100 includes a fluid supply chamber 10, a channel 14, a plurality of ejection chambers 11, a temperature adjustment module 19, and a tensor unit 15. The sensor unit 15 may include a sensor plate 15*a*. The fluid supply chamber 10 may store fluid. The channel 14 may establish fluid communication between the fluid supply chamber 10 and the ejection chambers 11. The ejection chambers 11 may include nozzles 12 and corresponding ejection members 13 to selectively eject the fluid through the respective nozzles 12. The temperature adjustment module 19 may establish at least one temperature of the fluid of the fluid ejection device 100. For example, the temperature adjustment module 19 may include heating circuits, or the like, to heat the fluid, for example, in the respective ejection chambers 11 to at least one temperature. In some examples, the temperature adjustment module 19 may selectively adjust the temperature of the fluid in the respective ejection, chambers 11 to a plurality of temperatures.

Referring to FIG. 1, in some examples, the sensor plate 15*a* of the sensor unit 15 may fee proximate to an ejection chamber 11 to detect impedance in the fluid corresponding to the at least one temperature to form at least one detected impedance value. For example, the sensor plate 15*a* may be disposed in at least one ejection chamber 11, the channel 14, or the like, to detect the impedance of the fluid therein. For example, the sensor plate 15*a* may be disposed in a respective ejection chamber 11 that corresponds to a testing chamber. For example, a testing chamber may not eject fluid for the purposes of marking a document. The sensor plate 15*a* may be a metal sensor plate formed, for example, of Tantalum, or the like. In some examples, the sensor unit 16 may include a plurality of sensor plates 15*a* corresponding to a number of ejection chambers 11. Alternatively, the fluid ejection device 100 may include a plurality of sensor units 15 corresponding to the number of ejection chambers 11. For example, each one of the sensor units 15 may include a respective sensor plate 15*a* disposed proximate to the election chambers 11. The respective sensor plates 15*a*, for example, may be disposed in the ejection chambers 11, respectively.

Figure 2A:
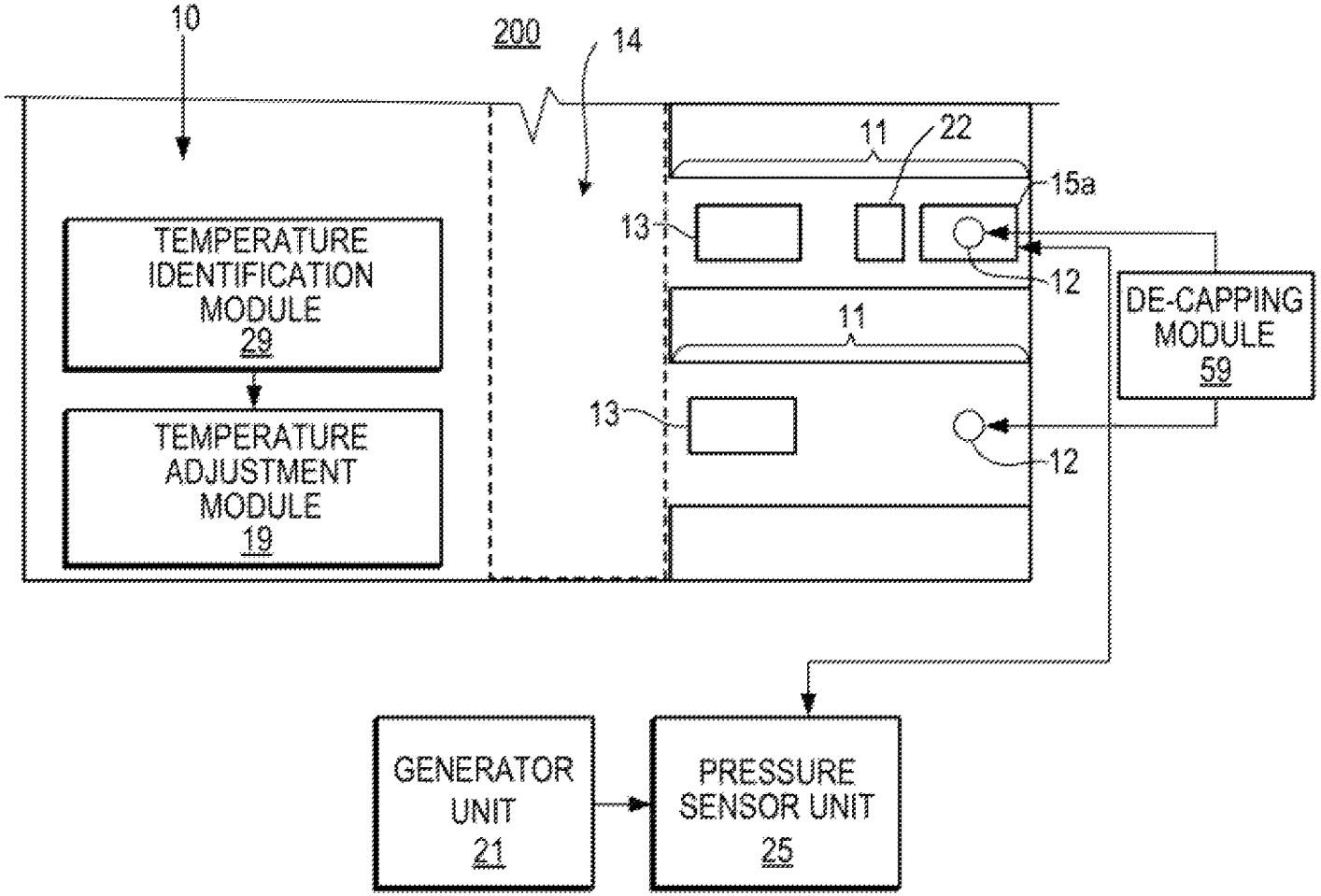
FIG. 2A is a schematic top view of a portion of the fluid ejection device of FIG. 1 according to an example.
Figure 2B:
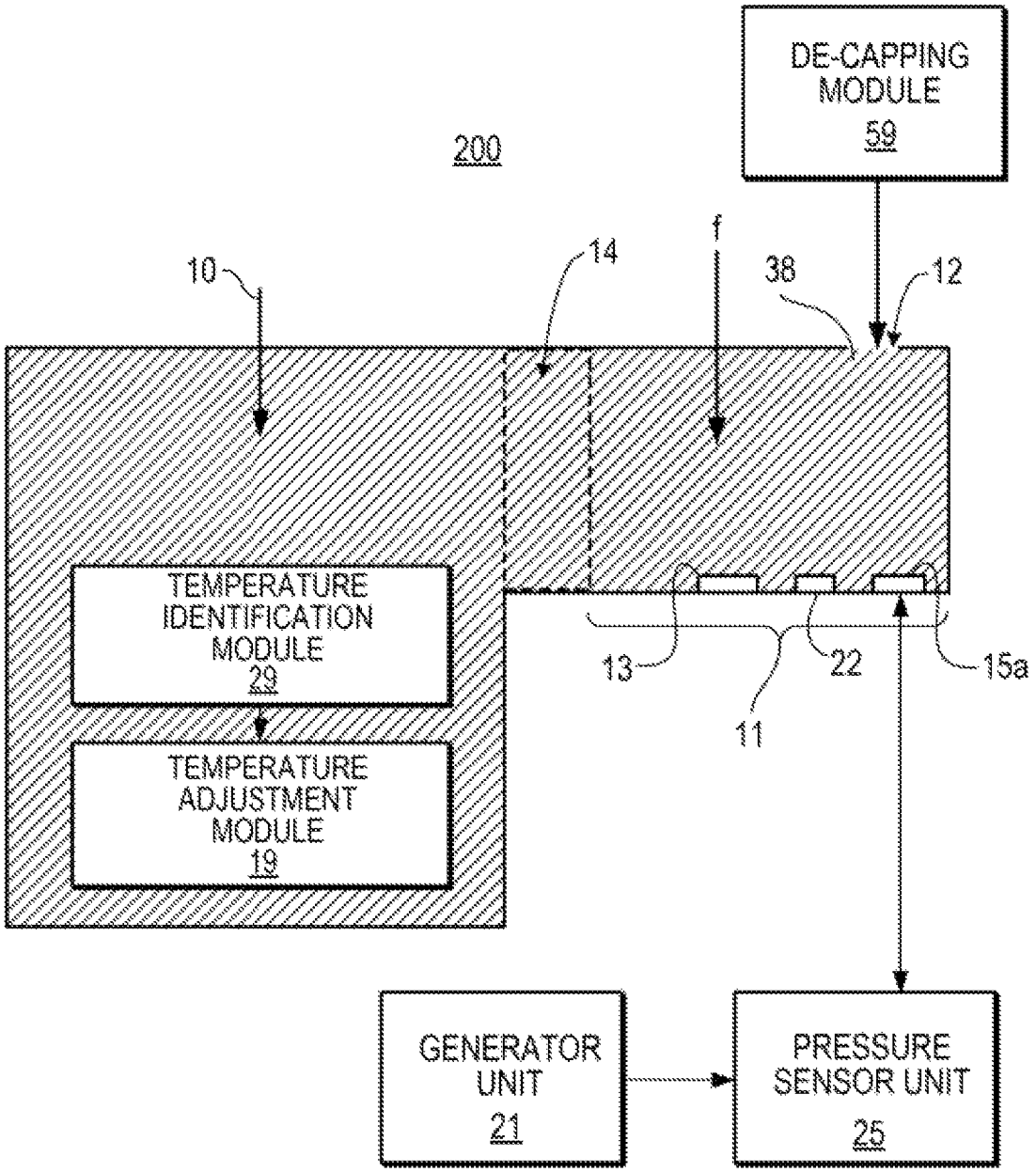
FIG. 2B is a schematic cross-sectional view of the fluid ejection device of FIG. 2A according to an example.

FIG. 2A is a schematic top view of the fluid ejection device of FIG. 1 according to an example. FIG. 2B is a schematic cross-sectional view of the fluid ejection device of FIG. 2A according to an example. Referring to FIGS. 2A and 2B, in some examples, a fluid ejection device 200 may include a fluid supply chamber 10, a channel 14, a plurality of ejection chambers 11, a temperature adjustment module 19, and a sensor unit 15 as previously disclosed with respect to the fluid ejection device 100 of FIG. 1. For example, the sensor unit 15 may be a pressure sensor unit 25. In some examples, the fluid ejection device 200 may also include a generator unit 21, a grounding member 22, a channel 14, a temperature identification module 29, and a de-capping module 59. The respective sensor plate 15*a* of the pressure sensor unit 21 may receive an electrical signal such as a pulse current from a generator unit 21 and transmit it into the fluid f in contact there with. In some examples, the grounding member 22 and/or the generator unit 21 may be considered part of the pressure sensor unit 25. The pressure sensor unit 25 may include an air bubble detect micro-electro-mechanical systems (ABD MEMS) pressure sensor.

Pressure sensing events, for example, occur with a change in pressure in the fluid ejection device 200, for example, due to spitting, printing or priming. That is, a meniscus 38 of the fluid may move and change a cross-section of fluid in at least the ejection chamber 11 between the sensor plate 15*a* and respective grounding member 22. In some examples, a change in cross-section of the fluid may be measured as an impedance change and correspond to a voltage output change. The electrical signal may be conducted, for example. In the form of a pulse current, from the respective sensor plate 15*a* to a grounding member 22 by passing through fluid disposed there between. For example, the grounding member 22 may be disposed in the respective ejection chamber 11 in a form of a cavitation member and/or cavitation layer. The grounding member 22, for example, may also be disposed along the sidewalls of the channel 14 and/or in the fluid supply chamber 10. In some examples, a capacitive element to impedance may form on the grounding member and a pulse current may assist in a determination of impedance which may be proportional to a cross-section of the fluid body between the respective sensor plate 15*a* and the grounding member 22.

The respective impedance in the fluid f may be a function of voltage. In some examples, the impedance of the fluid f may relate to voltage output by the pressure sensor unit 25, for example, in response to the electrical signal transmitted into the fluid f, for example, the pressure sensor unit 25 may output voltage in response to the electrical signal such as a current pulse transmitted into fluid f. The changes in the voltage output by the pressure sensor unit 25, such as shifts in absolute voltage values and rates of change in voltage values with respect to pulse duration of the pulse current may correspond to an imaginary portion (e.g., capacitive portion) of impedance. Additionally, the changes in absolute voltage values of the voltage output by the pressure sensor unit 25 may correspond to changes in the real portion (e.g., resistive portion) of the impedance. For example, given equal fluid and sensor geometry and temperature, the real and imaginary portion of impedance may change for different fluids. In some examples, when pressure sensing at a given temperature, generally the resistive portion (real) may change. The imaginary portion, however, may not appreciably change.

If the impedance is purely real, (e.g., resistive) then the time duration of the current pulse may not change the magnitude of output readings corresponding thereto. In the case where all or some portion of the impedance being measured is reactive, the duration of the current pulse may affect the magnitude of the output reading thereto. Multiple output readings at multiple current pulse durations can be used to solve for various real and reactive components of the impedance. Accordingly, the detected impedance may include measurements impacted, for example, by the time duration of current pulses and/or measurements not impacted by, for example, the time duration of current pulses.

Referring to FIGS. 2A and 2B, in some examples, the channel 14 may establish fluid communication between the fluid supply chamber 10 and the ejection chambers 11. That is, fluid f may be transported through the channel 14 from the fluid supply chamber 19 to the ejection chambers 11. In some embodiments, the channel 14 may be in a form of a single channel such as a fluid slot. Alternatively, the channel 14 may be in a form of a plurality of channels. The temperature identification module 29 may identify temperatures in the fluid election device 200. For example, the temperature identification module 29 may identify the at least one temperature of the fluid ejection device 200. In some examples, the temperature identification module 29 may communicate with the temperature adjustment module 19. For example, the fluid identification module 29 may provide the current temperature of the fluid f to the fluid adjustment module 19. The temperature identification module 29 may include a temperature sensor, a sensor circuit, or the like.

Referring to FIGS. 2A and 2B, in some examples, the at least one temperature may correspond to a temperature of fluid f in a respective ejection chamber 11. In some examples, the temperature adjustment module 29 may adjust the temperature of the fluid f based on a temperature identified by the temperature identification module 29. Although the temperature adjustment module 19 and the temperature identification module 29 are illustrated in the fluid supply chamber 10, the temperature adjustment module 19 and/or the temperature identification module 29 may fee disposed outside of the fluid supply chamber 10 such as in the respective ejection chamber 11, the channel 14, or the like.

The pressure sensor unit 25 may selectively detect a first impedance of the fluid f corresponding to a first temperature established by the temperature adjustment module 19. The pressure sensor unit 25 may also detect a second impedance of the fluid f corresponding to a second temperature established by the temperature adjustment module 19. The second temperature may be different than the first temperature. In some examples, the pressure sensor unit 25 may detect a plurality of impedances in the fluid corresponding to the at least, one temperature to obtain a plurality of detected impedance values at predetermine time periods. Thus, several impedance values over time for the same temperature may be obtained.

Referring to FIGS. 2A and 2B, in some examples, the de-capping module 59 may have a non-capped state and a capped state. That is, in the non-capped state, external ambient air may enter into the respective nozzle 12, for example, during sensing of backpressure events, during prime or unintentionally by gulping of air when there is a nozzle health problem. Additionally, fluid may be selectively elected through the respective nozzle 12. Alternatively, in the capped state, the respective nozzle 12 is placed in a quiescent state. For example, the humidity therein is kept high due to the small air volume and evaporation of water from the nozzles. Additionally, fluid may not be ejected through the respective nozzle 12. The de-capping module 59 may place the respective nozzles 12 in a non-capped state for a period of time. In some examples, the de-capping module 59 may be a movable nozzle cover to cover the respective nozzles 12 in the capped state and uncover the respective nozzles 12 in the non-capped state. In some examples, the fluid ejection device 100 may be an inkjet printhead device.

Figure 3:
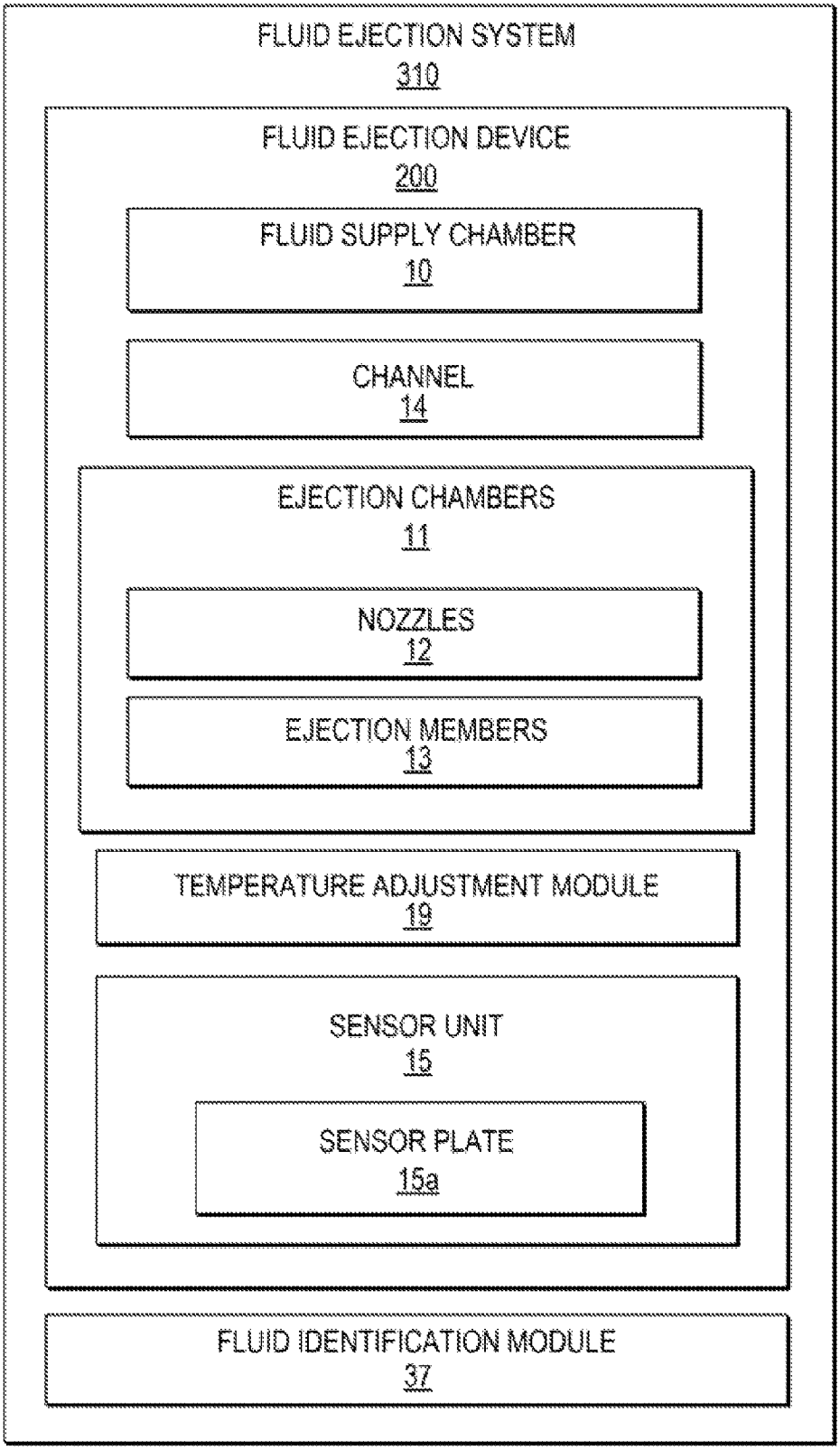
FIG. 3 is a block diagram illustrating a fluid ejection system according to an example.

FIG. 3 is a block diagram illustrating a fluid ejection system according to an example. Referring to FIG. 3, in some examples, a fluid ejection system 310 may include the fluid ejection device 100 including a fluid supply chamber 10, a channel 14, a plurality of ejection chambers 11, a temperature adjustment module 19, and a sensor unit 16 as previously disclosed with respect to FIG. 1. The fluid ejection system 310 may also include a fluid identification module 37 to identify a characteristic of the fluid based on the at least one detected impedance value to obtain an identified fluid characteristic. In some examples, the characteristic of the fluid may be a physical property and/or chemical properly such as a concentration of ions in the fluid, or the like. In some examples, the characteristic may also identify fluid with properties incompatible with the respective fluid ejection device 100 as well as manufacturer information. Additionally, the fluid identification module 37 may identify a plurality of characteristics of the fluid.

Figure 4:
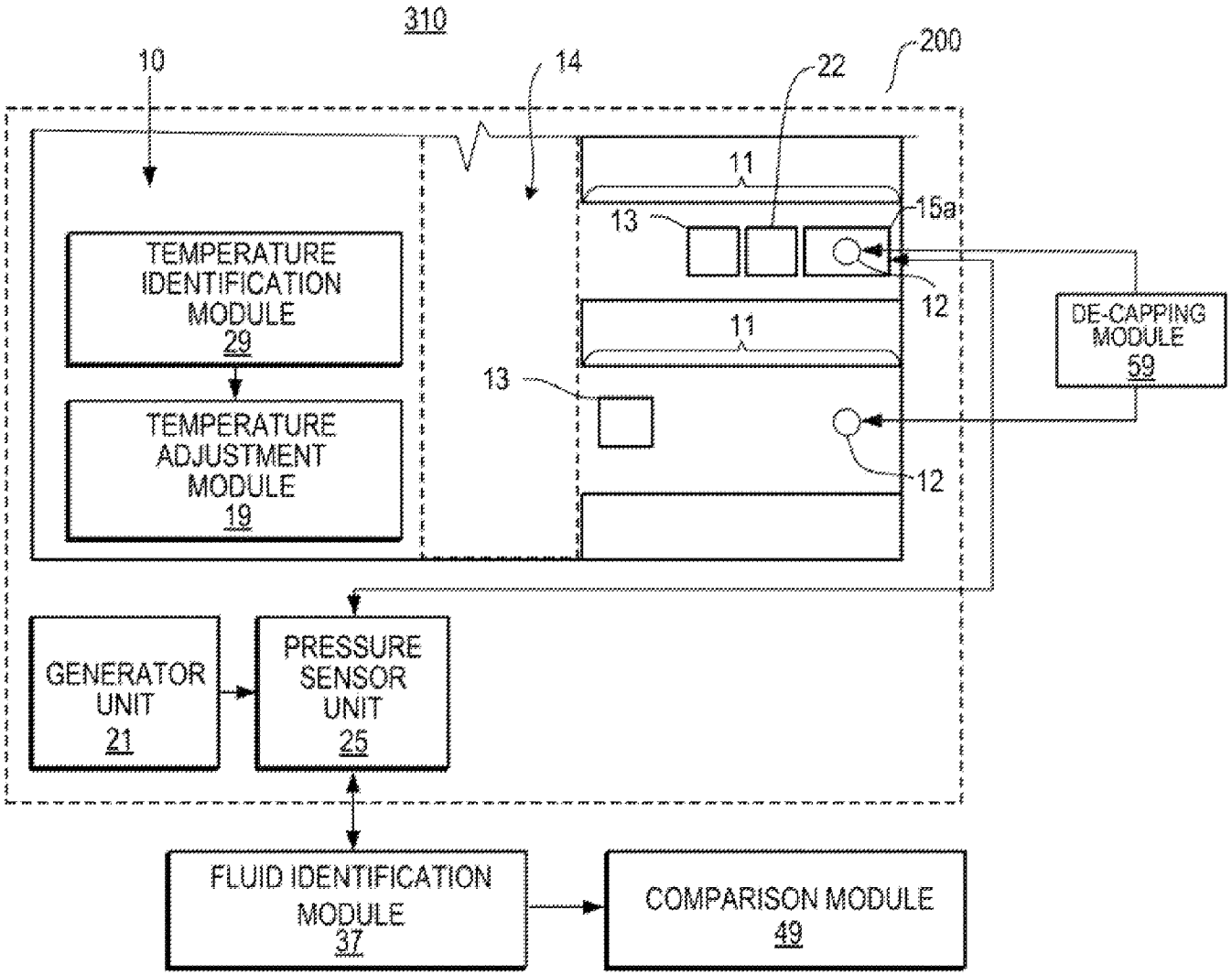
FIG. 4 is a schematic top view of the fluid election system of FIG. 3 according to an example.

FIG. 4 is a schematic view of the fluid ejection system of FIG. 3 according to an example. Referring to FIG. 4, in some examples, a fluid ejection system 310 may include the fluid ejection device 100 including a fluid supply chamber 10, a channel 14, a plurality of ejection chambers 11, a temperature adjustment module 19, and a sensor unit 15 as previously disclosed with respect to the fluid ejection device 200 of FIG. 3. The sensor unit 25 may be in a form of a pressure sensor unit 25 such as an ABD MEMS pressure sensor. The fluid ejection system 310 may also include a generator unit 21, a grounding member 22, a temperature indication unit 29, and a de-capping module 59 as previously disclosed with respect to the fluid ejection device 200 of FIGS. 2A and 2B. The fluid ejection system 310 may also include a comparison module 49 to compare the identified fluid characteristic with a predetermined fluid characteristic to obtain a comparison result. For example, the comparison module 49 may obtain the identified fluid characteristic from the fluid identification module 37 and compare 1 with a corresponding predetermined fluid characteristic from memory. The comparison module 49 may also determine a condition of the fluid based on the comparison result.

In some examples, the condition of the fluid may be a healthy fluid state. That is, a state of the fluid which is appropriate to be ejected from a respective fluid ejection device 200 onto an object. The predetermined fluid characteristic may include a respective characteristic having a known value corresponding to a healthy state of the fluid being compared. In some examples, the known value may correspond to the respective fluid ejection device 200 in which the fluid is used. For example, the known value of a healthy state of the fluid for a respective fluid ejection device 200 may be obtained from specifications, experiments, or the like. In some examples, such values may be stored memory such as in a form of a lookup table. That is, the memory may store known values of characteristics expected for respective inks at respective temperatures, de-capping states, or the like. For example, acceptable ranges of output voltages of the sensor unit 15 for given current pulse specifications for known, ionic concentrations of respective inks at various temperatures may be stored in memory in a form of a lookup table, or the like. The fluid ejection system 310 may be in a form of an image forming system such as an inkjet printing system, or the like. The fluid election device 200 may be in a form of an inkjet printhead device, or the like. Additionally, the fluid may be in a form of ink, or the like.

Figure 5A:
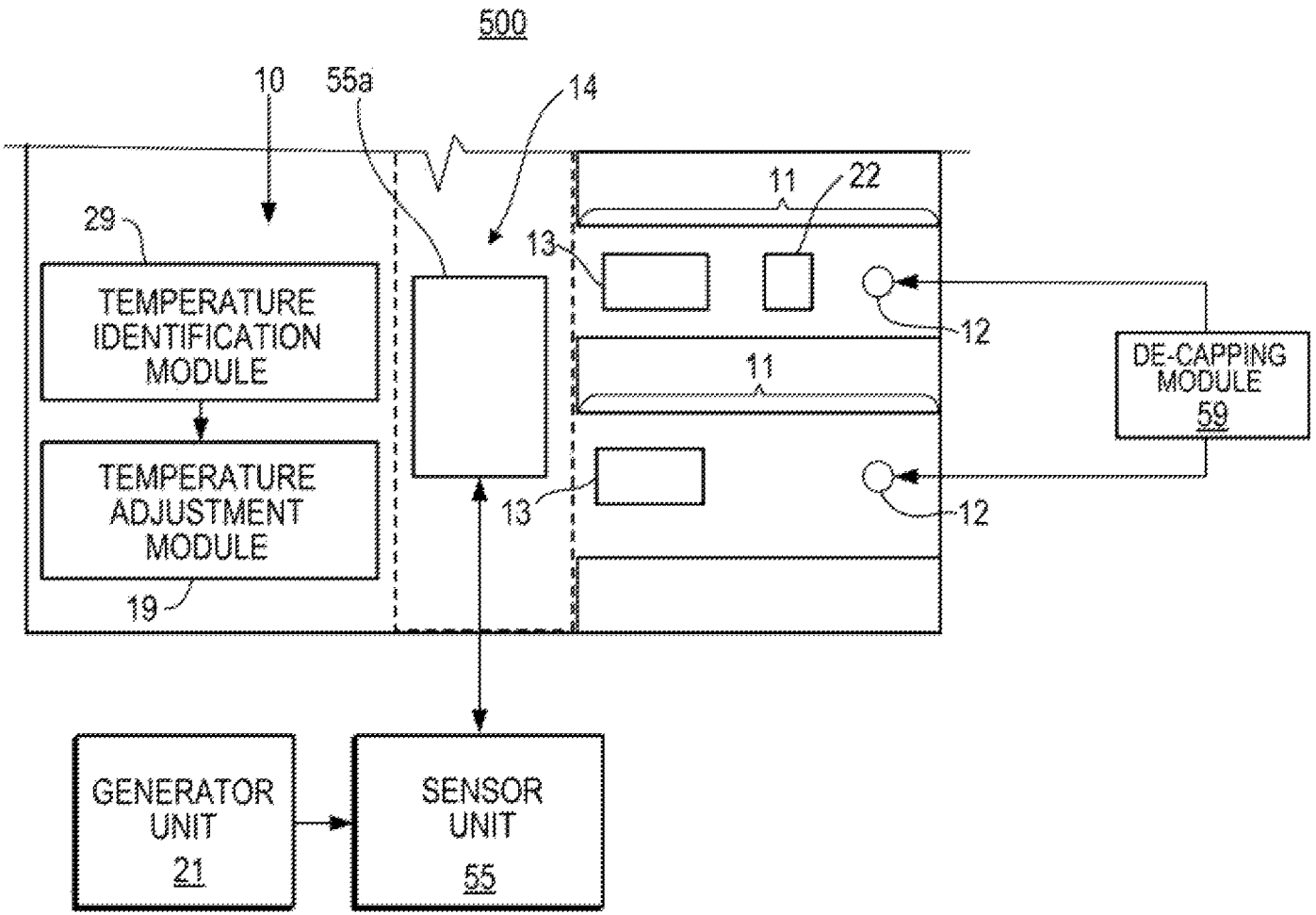
FIG. 5A is a schematic top view of the fluid ejection device of FIG. 1 according to an example.
Figure 5B:
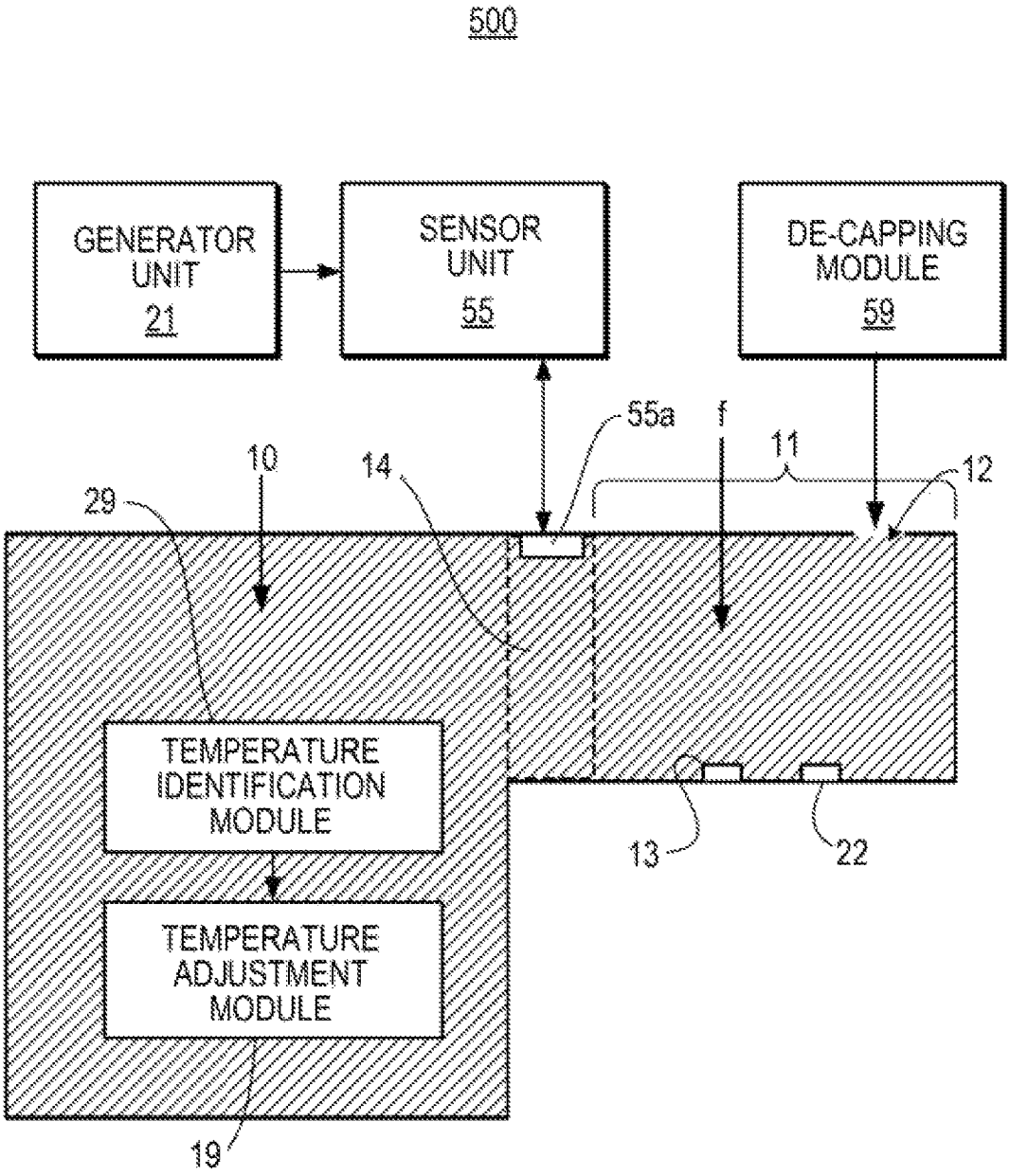
FIG. 5B is a schematic cross-sectional view of the fluid ejection device of FIG. 5A according to an example.

FIG. 5A is a schematic top view of the fluid ejection device of FIG. 1 according to an example. FIG. 5B is a schematic cross-sectional view of the fluid ejection device of FIG. 5A according to an example. Referring to FIGS. 5A and 5B, in some examples, the fluid ejection device 500 may include a fluid supply chamber 10, a channel 14, a plurality of ejection chambers 11, a temperature adjustment module 19, and a sensor unit 55 as previously disclosed with respect to FIG. 1. Referring to FIGS. 5A and 5B, the fluid ejection device 500 may also include a generator unit 21, a grounding member 22, a temperature identification module 29, and a de-capping module 59 as previously discussed with respect to the fluid ejection device 200 of FIGS. 2A and 2B. The generator unit 21 may supply a multi-frequency excitation signal to the sensor unit 55. The sensor unit 55 may transmit the multi-frequency excitation signal from the sensor plate 15*a* through the fluid to a grounding member 22 to obtain one of a range of voltage values and a range of current values on the sensor plate 15*a*. For example, the multi-frequency excitation signal may include one of a sinusoidal waveform and a pulse waveform. The sensor unit 55 may defect electrochemical impedances based on the respective frequencies of the multi-frequency excitation signal and the one of the range of voltage values and the range of current values.

In some examples, electrochemical impedances may be obtained through electrochemical impedance spectroscopy. Electrochemical impedance spectroscopy (e.g., EIS) is an electrochemical technique that may include application of a sinusoidal electrochemical pertubation (e.g., voltage or current) to a sample that covers a wide range of frequencies. Such a multi-frequency excitation may allow measurement of electrochemical reactions therein that take place at different rates and capacitance of a respective electrode. For example, in some examples, the sample may be the fluid in the fluid ejection device 500 and the respective electrode may be the sensor plate 15*a*. The electrochemical impedance may be in the form of an electrochemical impedance spectrum and/or data to provide a plurality of impedance values. In some examples, the sensor unit 65 may also selectively detect a plurality of impedances in the fluid f at predetermined time periods while the nozzles 12 are in the capped or non-capped state.

Figure 6:
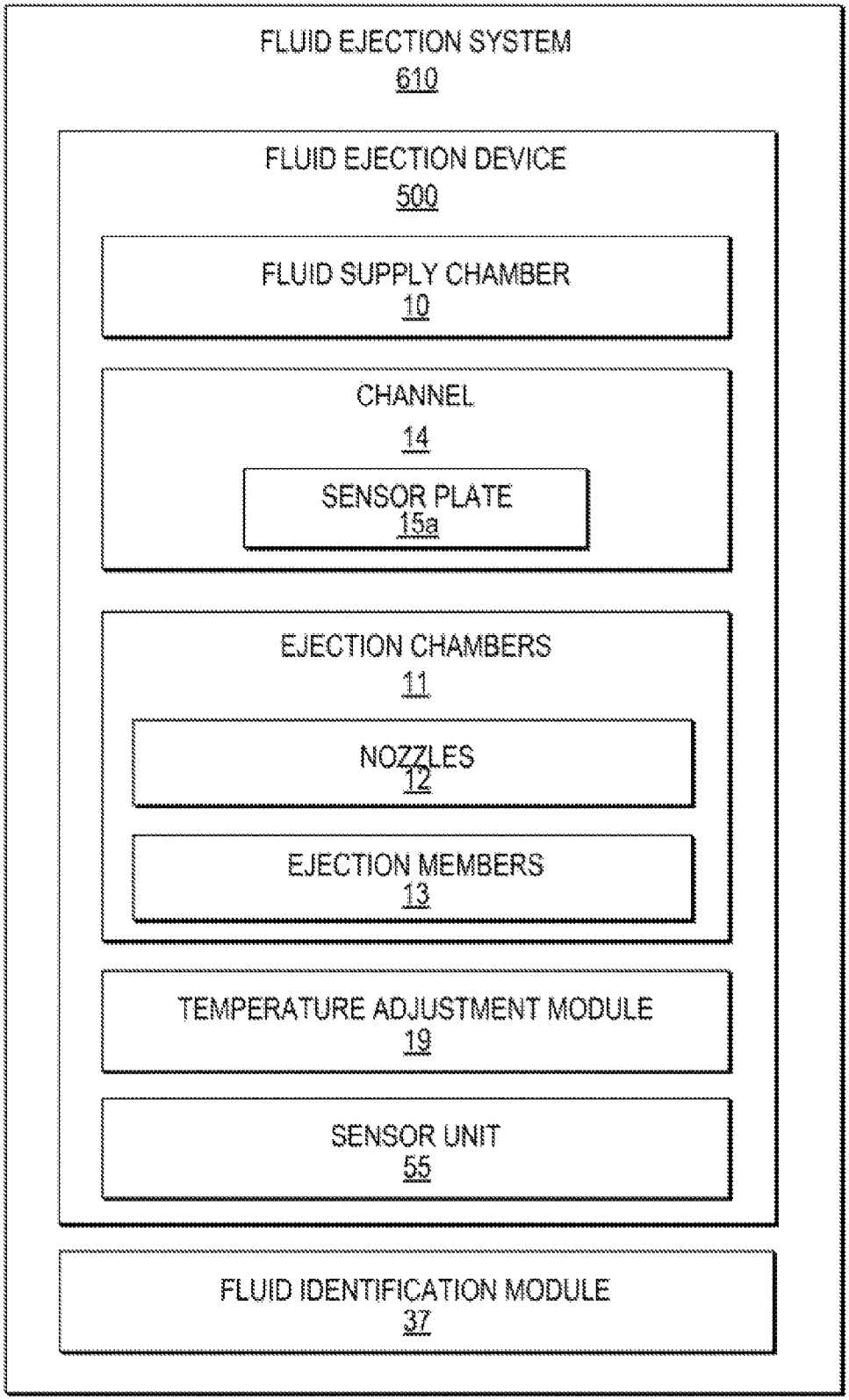
FIG. 6 is a block diagram illustrating a fluid ejection system according to an example.
Figure 8:
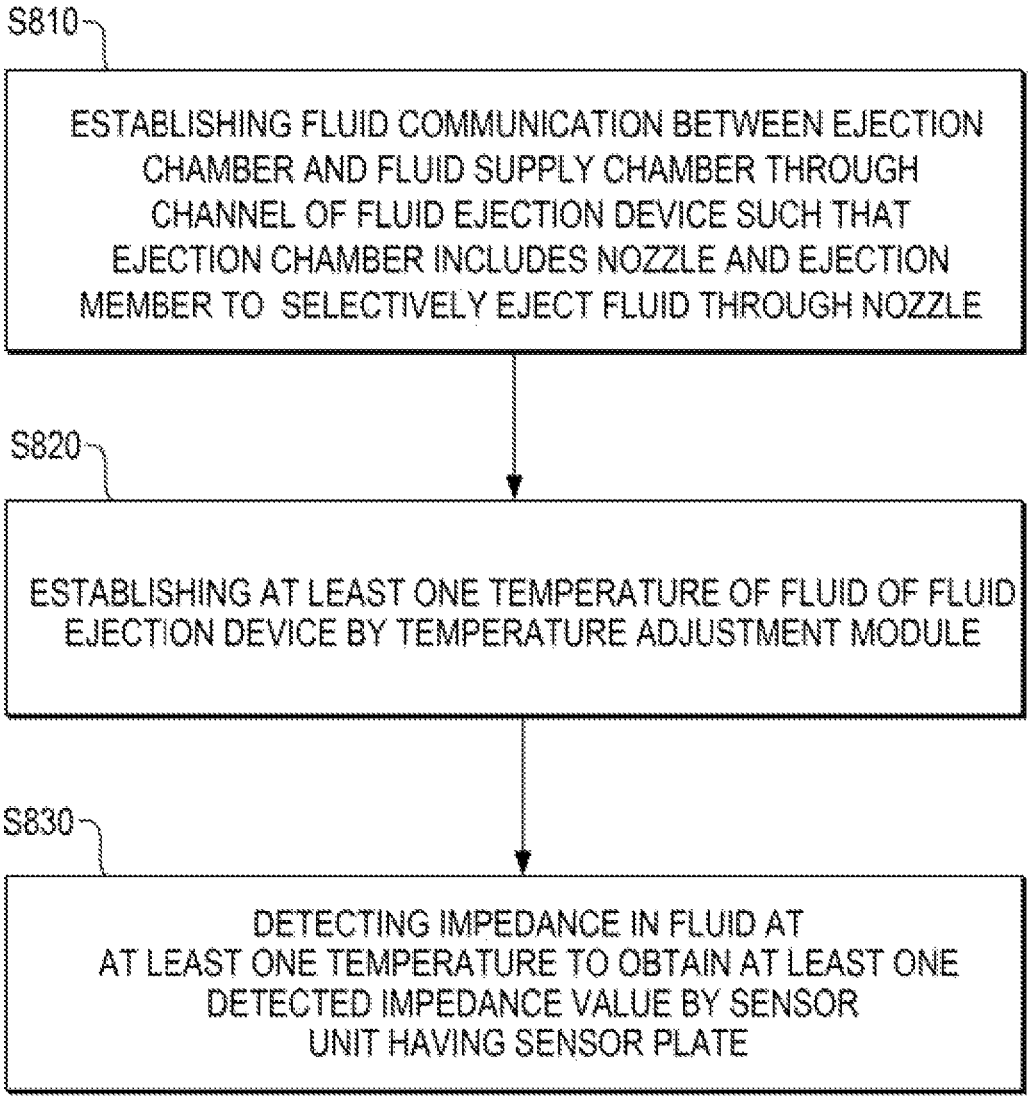
FIG. 8 is a flowchart illustrating a method of detecting impedance in fluid in a fluid ejection device according to an example.

FIG. 8 is a block diagram illustrating a fluid ejection system according to an example. Referring to FIG. 6, in some examples, a fluid ejection system 610 may include the fluid ejection device 500 including a fluid supply chamber 10, a channel 14, a plurality of ejection chambers 11, a temperature adjustment module 19, and a sensor unit 55 as previously disclosed with respect to FIGS. 5A-5B. The fluid ejection system 710 may also include a fluid identification module 37 to identify a characteristic of the fluid based on the at least one detected impedance value by the sensor unit 55 to obtain an identified fluid characteristic. In some examples, the at least one detected impedance value may be a plurality of detected impedances, for example, obtained through EIS. The use of a plurality of detected impedances may allow a more accurate identification of fluid characteristics.

For example, the use of multiple impedance values can determine a characteristic signature of a fluid even though some settling of elements such as pigment has occurred. Multiple impedance values may also be used to determine if there is differential loss of one component of the fluid. For example, when higher molecular weight organic solvents and water are used together as part of an ink vehicle, the water may evaporate at a higher rate. The use of multiple impedance measurements at multiple frequencies enables compensating for measurement variations due to such effects, or the like. The fluid characteristic, for example, may be a concentration of ions in the fluid, or the like. In some examples, the fluid identification module 37 may identify a plurality of characteristics of the fluid.

Figure 7:
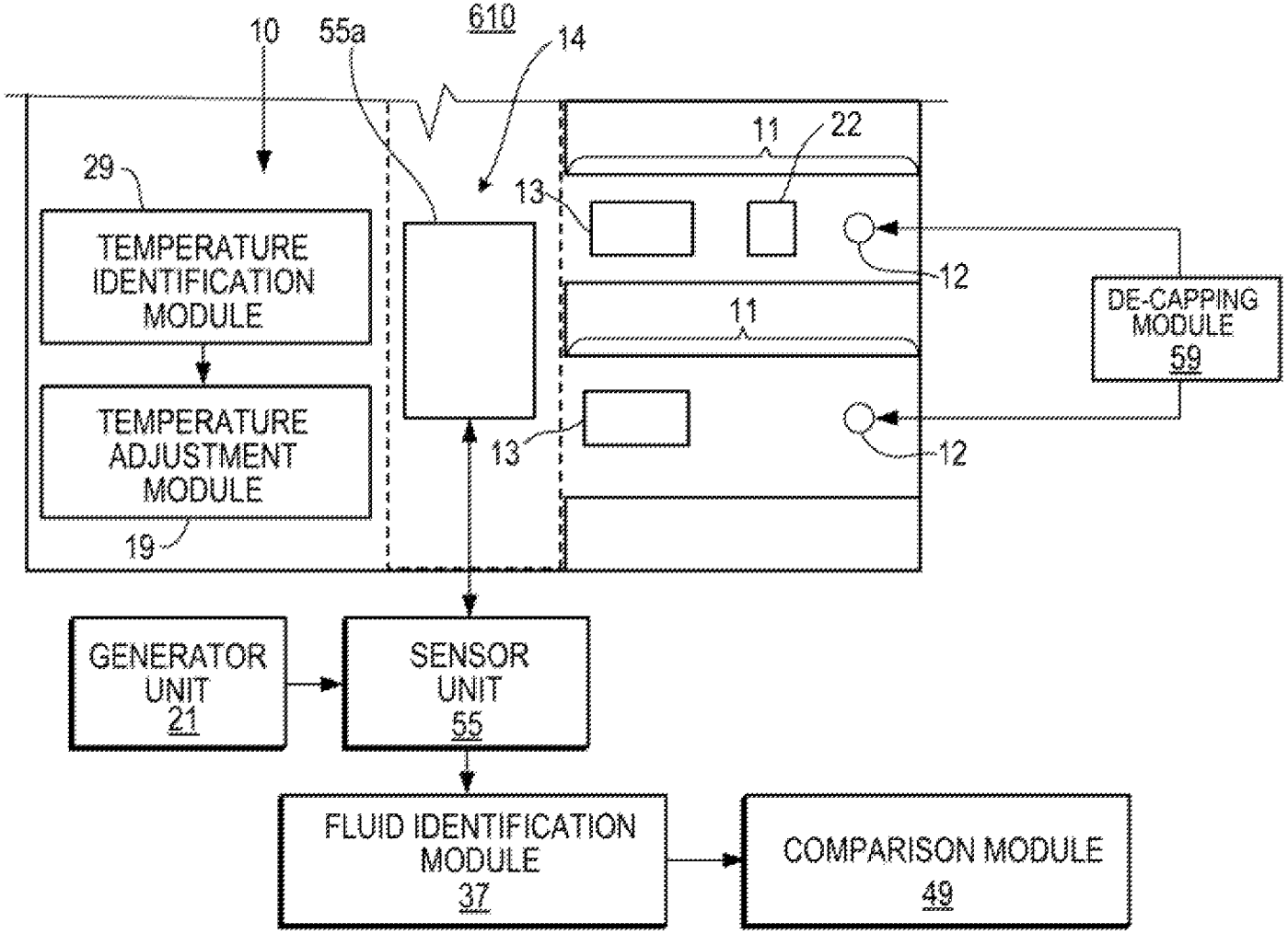
FIG. 7 is a schematic top view of the fluid ejection system of FIG. 6 according to an example.

FIG. 7 is a schematic top view of the fluid ejection systems of FIG. 6 according to an example. Referring to FIG. 7, in some examples, the fluid ejection system 610 may include a fluid supply chamber 10, a channel 14, a plurality of ejection chambers 11, a temperature adjustment module 19, a sensor unit 55, and a fluid identification module 37 as previously disclosed with respect to the fluid ejection device 500 of FIGS. 5A-6. In some examples, the fluid ejection system 810 may also include a generator unit 21, a grounding member 22, a temperature identification module 29, and a de-capping module 59, as previously disclosed with respect to FIGS. 5A and 5B.

Referring, to FIG. 7, in some examples, the fluid ejection system 610 may also include a comparison module 49. The comparison module 49 may compare the identified fluid characteristic win a predetermined fluid characteristic to obtain a comparison result and to determine a condition of the fluid based on the comparison result. For example, the comparison module 49 may obtain the identified fluid characteristic from the fluid identification module 37 and compare it with a corresponding predetermined fluid characteristic from memory. The fluid ejection system 610 may be in a form of an image forming system such as an inkjet printing system, or the like. The fluid ejection device 500 may be in a form of an inkjet printhead device, or the like. Additionally, the fluid may be in a form of ink, or the like.

In some examples, the temperature adjustment module 19, temperature identification module 29, sensor unit 15 and 55, pressure sensor unit 25, fluid identification module 37, comparison module 49, and/or de-capping module 59 may be implemented in hardware, software, or in a combination of hardware and software. In some examples, the temperature adjustment module 19, temperature identification module 29, sensor unit 15 and 56, pressure sensor unit 25, fluid identification module 37, comparison module 49, and/or de-capping module 58 may be implemented in part as a computer program such as a set of machine-readable instructions stored in the fluid ejection device 100, 200 and 500 and/or fluid ejection system 310 and 810, locally or remotely. For example, the computer program may be stored in a memory such as a server or a host computing device.

FIG. 3 is a flowchart illustrating a method of detecting impedance in fluid in a fluid ejection device according to an example. Referring to FIG. 8, in block S810, fluid communication is established between an election chamber and a fluid supply chamber through a channel of the fluid ejection device such that the ejection chamber includes a nozzle and an ejection member to selectively eject fluid through the nozzle. In block S820, at least one temperature of the fluid of the fluid ejection device is established by a temperature adjustment module. For example, the temperature adjustment module may heat fluid in the at least one of the ejection chamber, channel, and fluid supply chamber. In block S830, at least one impedance in the fluid is detected at the at least one temperature to obtain at least one detected impedance value by a sensor unit having a sensor plate. In some examples, the sensor plate may be disposed in the ejection chamber. The sensor unit may be in a form of an ABD MEMS pressure sensor.

In some examples, the method may also include identifying the at least one temperature of the fluid ejection device by a temperature identification module. In some examples, the temperature identification module may communicate the current temperature of the fluid to the temperature adjustment module. The at least one temperature may include a plurality of temperatures. Accordingly, a plurality of impedances for the same fluid at different temperatures may be obtained. In some examples, the plurality of impedances may be a plurality of detected impedances, for example, obtained through EIS.

Figure 9:
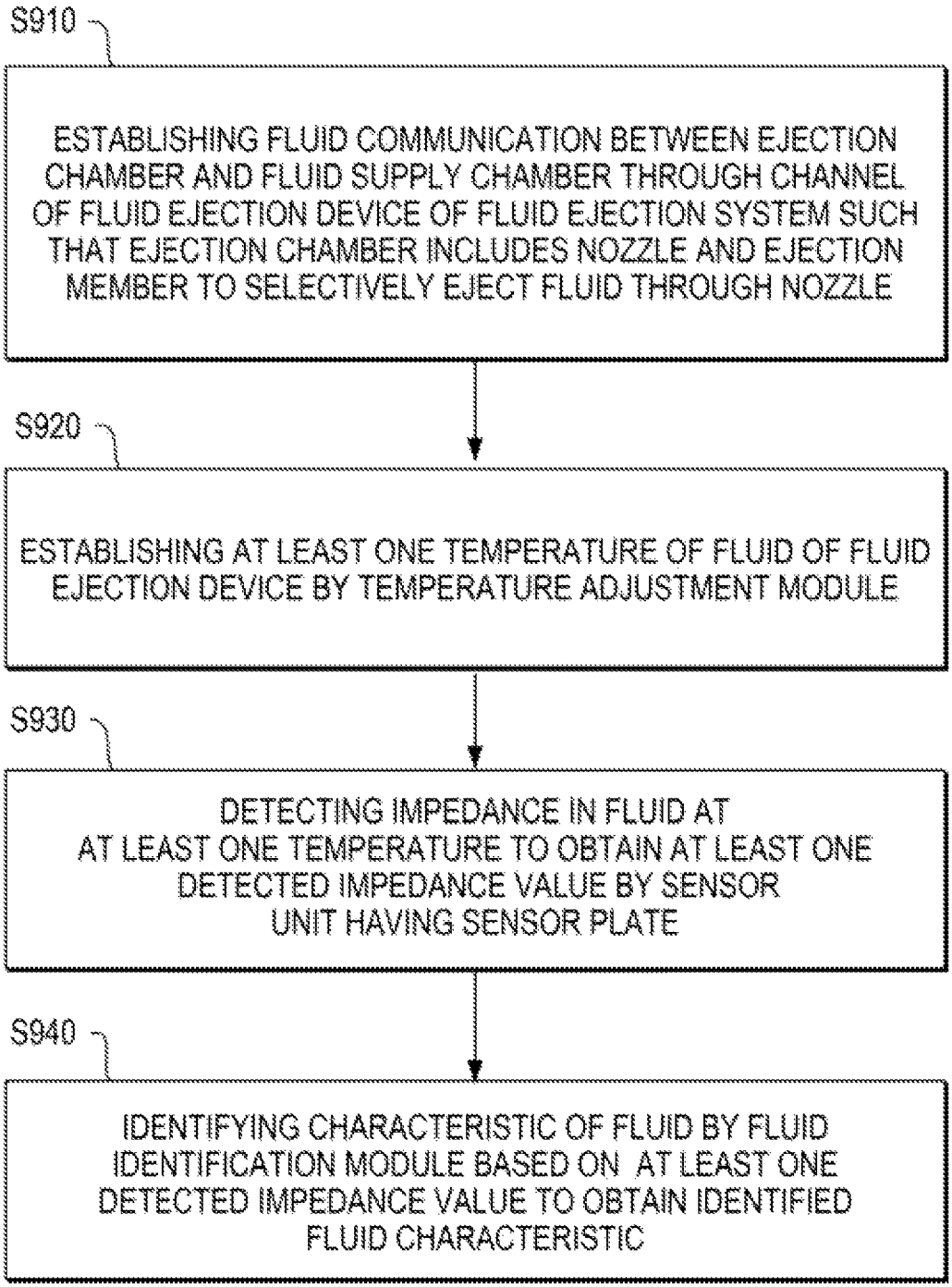
FIG. 9 is a flowchart illustrating a method of identifying a characteristic of fluid in a fluid ejection system according to an example.

FIG. 9 is a flowchart illustrating a method of detecting impedance in fluid in a fluid ejection system according to an example. Referring to FIG. 9, in block S910, fluid communication is established between an ejection chamber and a fluid supply chamber through a channel of a fluid ejection device of the fluid ejection system such that the ejection chamber includes a nozzle and an ejection member to selectively eject fluid through the nozzle. In block S820, at least one temperature of the fluid of the fluid ejection device is established by a temperature adjustment module. The at least one temperature may include a plurality of temperatures. The temperature adjustment module may heat fluid in the at least one of the ejection chamber, channel, and fluid supply chamber.

In block S930, at least one impedance in the fluid is detected at the at least one temperature to form at least one detected impedance value by a sensor unit having a sensor plate. For example, the fluid may be heated to the at least one temperature by a temperature adjustment module. For example, the temperature adjustment module may heat fluid in the at least one of the ejection chamber, channel, and fluid supply chamber. The method may also include identifying the at least one temperature of the fluid of the fluid ejection device of the fluid ejection system by a temperature identification module. The temperature identification module may provide a current temperature of the fluid to the temperature adjustment module. In some examples, a multi-frequency excitation signal may be supplied to the sensor unit from a generator unit. The multi-frequency excitation signal may be transmitted by the sensor unit from the sensor plate through the fluid to a grounding member to obtain one of a range of voltage values and a range of current values on the sensor plate.

Electrochemical impedances may be detected based on the respective frequencies of the multi-frequency excitation signal and the one of the range of voltage values and the range of current values. In some examples, the detected electrochemical impedances value may be a plurality of detected impedances, for example, obtained though EIS. In some examples, the sensor plate may be disposed in the ejection chamber, the channel or the like. The sensor unit may be in a form of an ABD MEMS pressure sensor.

In block S940, a characteristic of the fluid is identified by a fluid identification module based on the at least one detected impedance value to obtain an identified fluid characteristic. In some examples, the fluid identification module may identify a plurality of characteristics of the fluid. In some examples, the method may also include comparing the identified fluid characteristic with a predetermined fluid characteristic by a comparison module to obtain a comparison result and to determine a condition of the fluid based on the comparison result.

It is to be understood that the flowcharts of FIGS. 8-9 illustrate an architecture, functionality, and operation of an example of the present disclosure, if embodied in software, each block may represent a module, segment, or portion of code that includes one or more executable instructions to implement the specified logical function(s). If embodied in hardware, each block may represent a circuit of a number of interconnected circuits to implement the specified logical function(s). Although the flowcharts of FIGS. 8-9 illustrate a specific order of execution, the order of execution may differ from that which is depicted. For example, the order of execution of two or more blocks may be scrambled relative to the order illustrated. Also, two or more blocks illustrated in succession in FIGS. 8-9 may be executed concurrently or with partial concurrence. All such variations are within the scope of the present disclosure.

The present disclosure has been described using non-limiting detailed descriptions of examples thereof and is not intended to limit the scope of the present disclosure. If should be understood that features and/or operations described with respect to one example may be used with other examples and that not all examples of the present disclosure have all of the features and/or operations illustrated in a particular figure or described with respect to one of the examples. Variations of examples described will occur to persons of the art. Furthermore, the terms, "comprise," "include," "have" and their conjugates, shall mean, when used in the present disclosure and/or claims, "including but not necessarily limited to."

It is noted that some of the above described examples may include structure, acts or details of structures and acts that may not be essential to the present disclosure and are intended to be exemplary. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. A fluid ejection device, comprising:

a fluid supply chamber to store fluid;

a plurality of ejection chambers including nozzles and corresponding ejection members to selectively eject the fluid through the respective nozzles;

a channel to establish fluid communication between the fluid supply chamber and the ejection members;

a temperature adjustment module to establish at least one temperature of the fluid of the fluid ejection device; and a sensor unit having a sensor plate, the sensor unit to detect at least one impedance in the fluid corresponding to the at least one temperature;

wherein the sensor unit detects a plurality of impedances in the fluid corresponding to the at least one temperature at predetermine time periods.

2. The fluid ejection device according to claim 1, wherein the sensor unit selectively detects a first impedance of the fluid corresponding to a first temperature established by the temperature adjustment module and a second impedance of the fluid corresponding to a second temperature established by the temperature adjustment module different than the first temperature.

3. The fluid ejection device according to claim 1, wherein the sensor unit further comprises:

an air bubble detect micro-electro-mechanical systems (ABD MEMS) pressure sensor.

4. The fluid ejection device according to claim 1, further comprising a fluid identification module to identify a characteristic of the fluid based on the detected impedance.

5. The fluid ejection device according to claim 4, further comprising a comparison module for comparing the identified fluid characteristic with a predetermined fluid characteristic to produce a comparison result.

6. The fluid ejection device according to claim 5, wherein the predetermined fluid characteristic is stored in a lookup table accessible to the comparison module.

7. The fluid ejection device according to claim 6, wherein the lookup table stored predetermined fluid characteristics based on different temperatures and capped/decapped states of the fluid ejection device.

8. The fluid ejection device according to claim 1, further comprising a generator unit to supply a multi-frequency excitation signal to the sensor unit such that the sensor unit detects electrochemical impedances based on respective frequencies of the multi-frequency excitation signal.

9. The fluid ejection device according to claim 8, wherein sensor unit detects the electrochemical impedances using electrochemical impedance spectroscopy.

10. A fluid ejection device, comprising:

a fluid supply chamber to store fluid;

a plurality of ejection chambers including nozzles and corresponding ejection members to selectively eject the fluid through the respective nozzles;

a channel to establish fluid communication between the fluid supply chamber and the ejection members;

a temperature adjustment module to establish at least one temperature of the fluid of the fluid ejection device; and an air bubble detect micro-electro-mechanical systems (ABD MEMS) pressure sensor to detect at least one impedance in the fluid corresponding to the at least one temperature, the ABD MEMS including a sensor plate;

wherein the ABD MEMS detects a plurality of impedances in the fluid corresponding to the at least one temperature at predetermine time periods.

* * * * *